US005297311A

United States Patent [19]

Puri

[11] Patent Number: 5,297,311

[45] Date of Patent: Mar. 29, 1994

[54] VACUUM CLEANER

[75] Inventor: Krishan K. Puri, Richmond, Canada

[73] Assignee: Citywide Machine Wholesale, Inc., Vancouver, Canada

[21] Appl. No.: 882,984

[22] Filed: May 4, 1992

[51] Int. Cl.[5] ..... A47L 9/14

[52] U.S. Cl. ..... 15/347; 15/352; 15/353

[58] Field of Search ..... 15/347, 352, 353

[56] References Cited

U.S. PATENT DOCUMENTS 2,958,893 11/1960 Carlberg et al. ..... 15/347 X 3,524,211 8/1970 Wolf ..... 15/352 X

*Primary Examiner*—Chris K. Moore

*Attorney, Agent, or Firm*—Townsend and Townsend Khourie and Crew

[57] ABSTRACT

A vacuum cleaner having a body with an inlet opening for dust laden air and an outlet. An impeller is located between the inlet and the outlet. A chamber within the body having at least one wall receives a perforate dust receptacle. The chamber is located up-stream of the impeller. An inlet passageway extends from the inlet opening into the chamber. This passageway is directed so that when a perforate dust receptacle is in position in the chamber, the inlet passage has an outlet directed at a wall of the dust receptacle. Dust laden air entering the receptacle is filtered to remove dust. The dust laden air, forced against the wall by the impeller, acts to keep the wall free of dust accumulation.

7 Claims, 2 Drawing Sheets

VACUUM CLEANER

FIELD OF THE INVENTION

This invention relates to a vacuum cleaner. It finds particular application in small vacuum cleaners, easily moved and easily carried.

DESCRIPTION OF THE PRIOR ART

A problem with the vast majority of vacuum cleaners, of whatever type, is that the dust laden air to be filtered is fed into a partially filled filter compartment. The filter removes the dust as the air passes through. As the filtration proceeds, the air has to pass through more and more dust. The vacuum cleaner motor has to work harder and harder to force the air through the dust. This is undesirable both for efficiency of cleaning and for loads imposed on the motor.

SUMMARY OF THE INVENTION

The present invention provides a simple avoidance of this problem and provides a vacuum cleaner in which the dust laden air is directed against, and filtered by, at least a portion of the filter that is not clogged with dust.

Accordingly, and in its broadest aspect, the present invention is a vacuum cleaner comprising a body having an inlet opening for dust laden air and an outlet opening; an impeller between the inlet and the outlet; a chamber within the body to receive a perforate dust receptacle the chamber being located up-stream of the impeller; an inlet passageway extending from the inlet opening into the chamber and directed so that, when a perforate dust receptacle is in position in the chamber, the inlet passage has an outlet directed at said at least one wall of the perforate dust receptacle whereby dust laden air entering the receptacle is filtered to remove dust and the dust laden air, forced against said at least one wall by the impeller, acts to keep said at least one wall free of dust accumulation.

In a further aspect the invention is a vacuum cleaner comprising a body having an inlet opening for dust laden air and an outlet opening; an impeller between the inlet and the outlet; a perforate dust receptacle having at least one wall able to filter dust from the dust laden air; an inlet passage extending from the inlet opening into the perforate dust receptacle and having an outlet directed at said at least one wall whereby dust laden air entering the receptacle is filtered to remove dust and the dust laden air, forced against said at least one wall by the impeller, acts to keep said at least one wall free of dust accumulation.

DESCRIPTION OF THE DRAWINGS

The invention is illustrated in the drawings in which.

DESCRIPTION OF THE PREFERRED EMBODIMENTS

Figure 1:
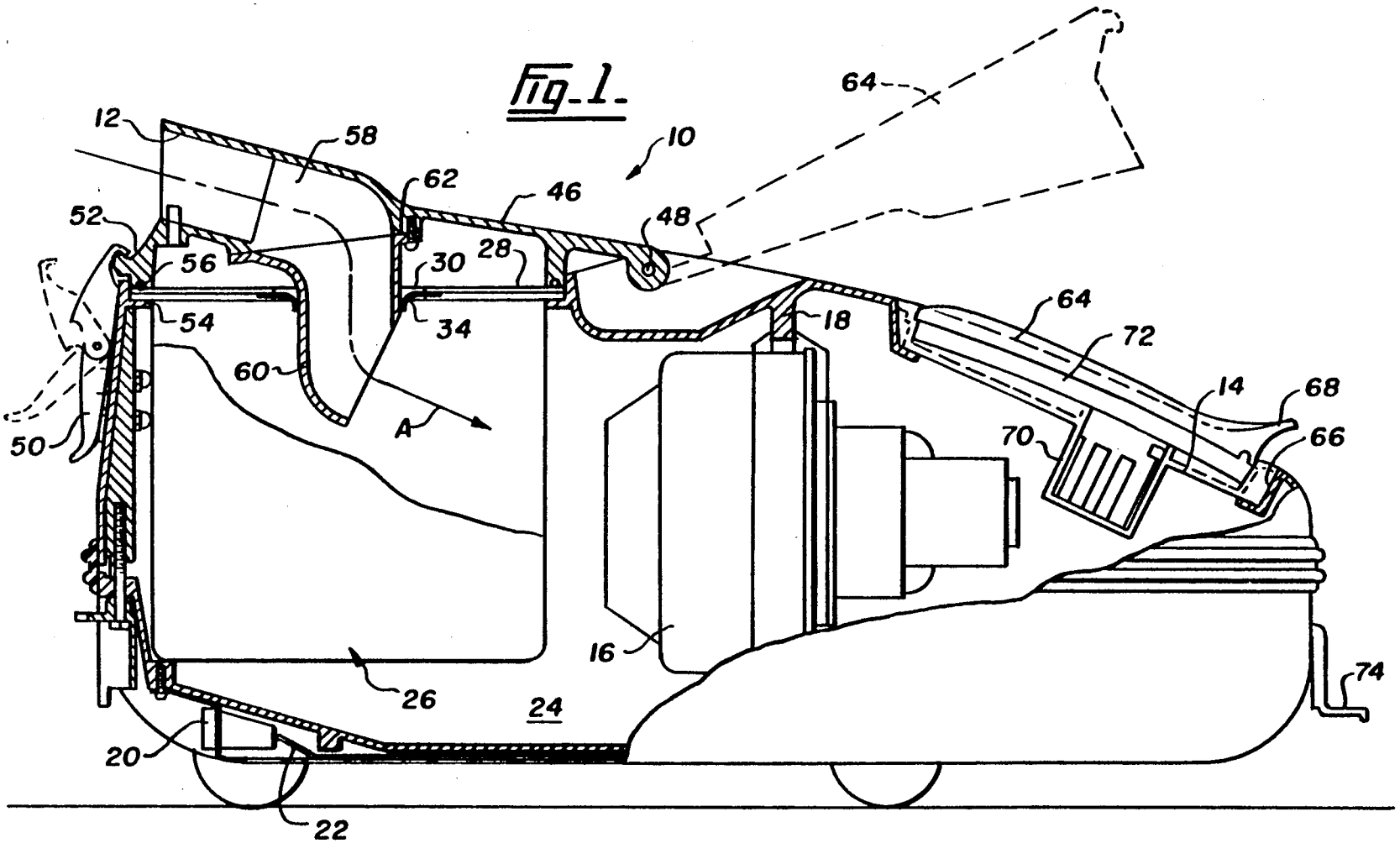
FIG. 1 is a section through a vacuum cleaner according to the present invention.

The drawings show a vacuum cleaner comprising a body 10. There is an inlet 12 for dust laden air and an outlet 14 in the body. An impeller 16 is located between the inlet 12 and the outlet 14 mounted on a wall 18 of the body 10. In the illustrated embodiment, the impeller 16 is an electric motor driving air in the direction of the arrow A shown in FIG. 1. There is a socket 20 from which a cable 22 extends to the motor to supply power to the motor.

Figure 2:
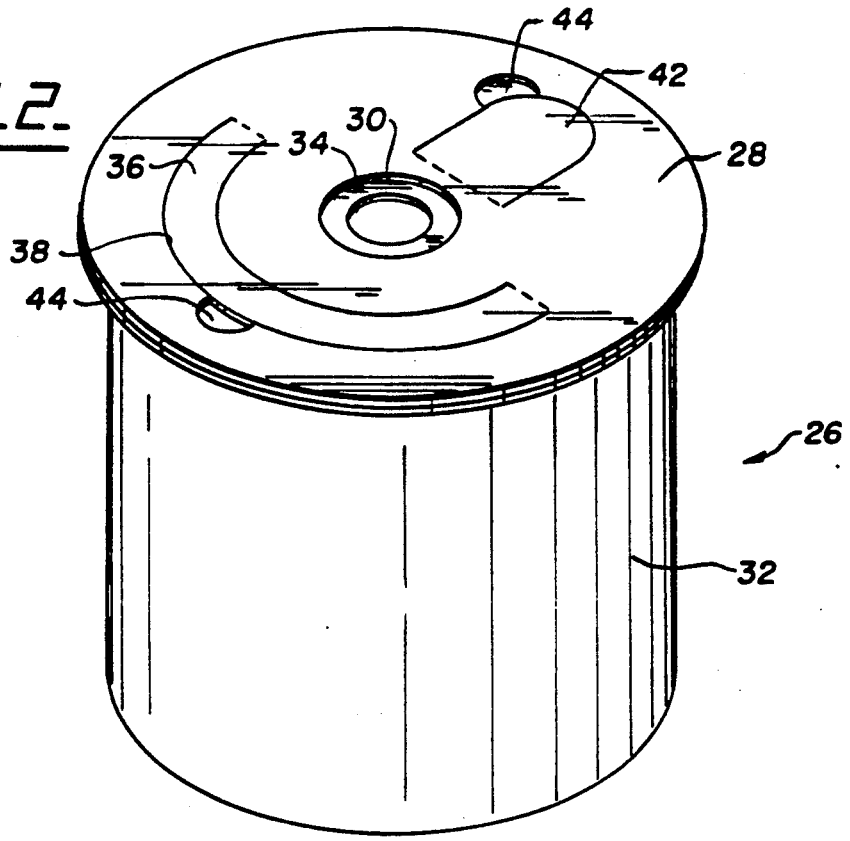
FIG. 2 is a perspective view of a perforate dust receptacle using in the vacuum cleaner of FIG. 1.
Figure 3:
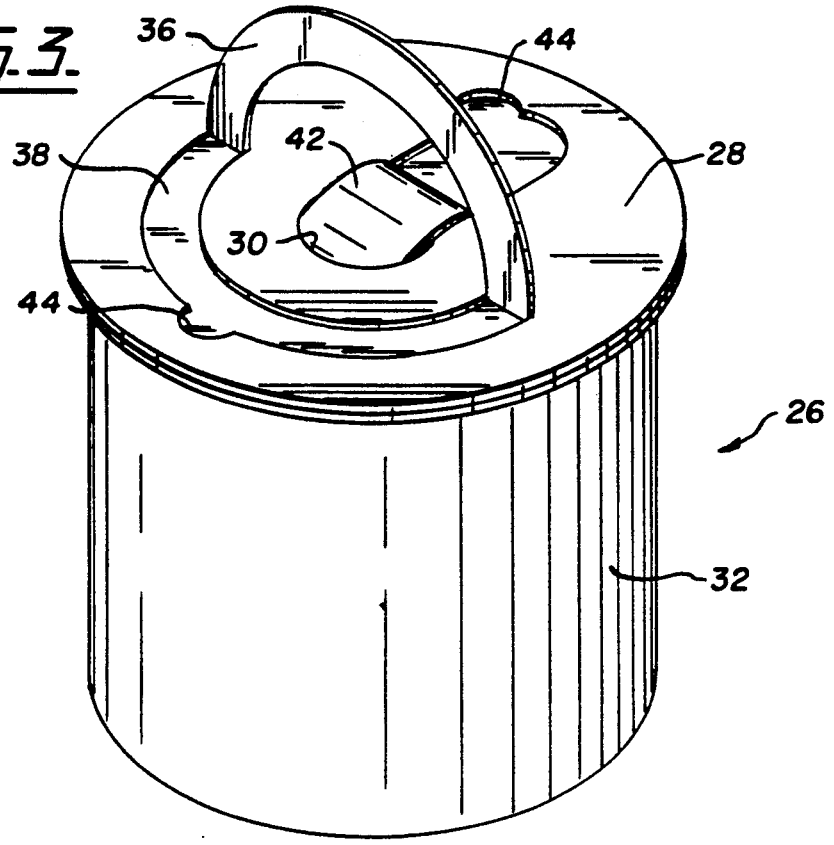
FIG. 3 is a further detail of the receptacle of FIG. 2.

There is a chamber 24 within the body 10 to receive a perforate dust receptacle 26. In the illustrated embodiment, as particularly shown in FIGS. 2 and 3, the dust receptacle 26 is removable. It is held in place in the chamber 24 during use but can be removed and, usually, discarded together with the contained dust. Receptacle 26 is shown in position in FIG. 1 but is also shown in FIGS. 2 and 3. Receptacle 26 has a relatively rigid top 28 with a central opening 30. The remainder of the receptacle 26 is formed by a perforate cylinder 32, typically of paper, attached to the top 28. The opening 30 is formed with a flexible gasket 34 as shown particularly in FIGS. 1 and 2. The top 28 is provided with a handle 36 which is normally a flush fit in a channel 38 provided in the top 28. There is a finger opening 40 to facilitate gripping of the handle 36 to remove it from the position shown in FIG. 2, where it is flush with the surface of the top 28 to the raised position shown in FIG. 3. A flap 42 is also formed in the top 28 again with an adjacent finger opening 44. FIG. 2 shows the position of the receptacle 26 when it is in position in the body 10, for example as shown in FIG. 1. FIG. 3 shows the position where the receptacle 26 is to be discarded. The flap 42 is raised using finger opening 44 and inserted within the gasket 34, thus sealing the opening 30 and the top 28 of the receptacle 26.

Access to the chamber 24, to allow introduction and removal of the receptacle 26 is through a door 46 pivotally mounted at 48 and locked by a catch 50 engaging a recess 52 in the door 46. Inlet 12 is an intragal part of the door 46. The body 10 is formed with flange 54 that contacts the under side of the top 28 of the receptacle 26. The door 46 is formed with a circumferential channel to receive an O-ring 56 that contacts the upper surface of the top 28 of the receptacle 26 to provide sealing.

There is an inlet passageway 58 extend from the inlet opening into the chamber 26. As shown particularly in FIG. 1, the inlet passageway 58 is formed by a pipe 60 attached to the inlet 12 at 62. Pipe 60 extends through opening 30 in the relatively rigid top 28 of the receptacle 26.

The opening 14 is closed with a perforate door 62, pivotally mounted at 66 and raisable by pressing on upstanding portion 68. A filter holder 70 extends downwardly from the door 64 which is also closed by a flat filter 72. This filtering removes any dust that may have passed through the wall of the receptacle 26 and ensures that no dust will enter the atmosphere.

A conventional foot switch 74 is shown attached to the body to switch the motor 16 on and off.

To use the device according to the present invention the door 46 is raised and a receptacle 26, in the condition shown in FIG. 2, is inserted into the chamber 24. The door 46 is closed. Catch 50 is engaged in recess 52 and locked. The foot switch 74 is operated to switch on the vacuum cleaner which is then operated by the use of a flexible pipe (not shown) extending from the inlet 12 to a head (not shown). Dust laden air is sucked along the pipe, through the inlet 12, through the pipe 60 and against the wall of the receptacle 26. The direction of the dust laden air, as shown by arrow A, is such that there is a constant forced draft at least against a part of the wall of the receptacle 26. This means that there is no tendency of the dust to accumulate against that wall. It tends to build in the receptacle 26 as shown in FIG. 1. The dust may be swirled within the receptacle but that is not a problem. The important point is that the dust-laden air is forced always against the clear wall. The motor is thus not strained and the filtration is effective. Should dust pass through the wall it is collected in the filters 70 and 72 located in the outlet 14.

When the receptacle 26 is so full that the air stream cannot maintains a clear portion of the wall of the receptacle 26 catch 56 is released and door 46 raised. This simultaneously removes the pipe 60 from the gasket 34 in the top of the receptacle 26. The flap 42 is raised, as shown in FIG. 3, and inserted into the opening. The handle 36 is then raised and the receptacle 26 removed and rejected, together with the contained dust.

A fresh container 26, in the form shown in FIG. 2, is then inserted, the door 46 is closed, the catch 50 fastened and the cleaner is then ready for use.

The receptacle 26 may be made of paper with the relatively rigid top 28 usually of cardboard. A rubber annulus forms the gasket 34. The body 10 can be cased from aluminum or from plastic.

In the preferred embodiment illustrated the cylinder 32 will be wholly perforate but it is envisaged that there may just be a portion of the wall that is perforate.

Filter 70 may be a simple carbon filter can be used to ensure that no dust re-enters the atmosphere.

I claim:

1. A vacuum cleaner comprising:

a body having an inlet for dust laden air and an outlet;

a first door pivotally mounted to the body and containing the inlet for dust laden air;

an impeller between the inlet and the outlet;

a perforate dust receptacle able to filter dust from the dust laden air;

an inlet pipe extending from the inlet for dust laden air into the perforate dust receptacle when the first door is closed;

said perforate dust receptacle including a relatively rigid top having an opening to receive the pipe, the remainder of the dust receptacle being a perforate cylinder attached to the top and having at least one wall;

a flexible gasket positioned in said opening of the perforate dust receptacle, said flexible gasket receiving said pipe to provide a close fit around the pipe;

a flap formed flush with the top of the perforate dust receptacle, the flap including means for raising and folding the flap over the opening to seal the opening for disposal of the perforate dust receptacle without loss of the dust;

said inlet pipe having an outlet remote from the lid, said inlet pipe being directed at said at least one wall whereby dust laden air entering the receptacle is filtered to remove dust and the dust laden air, forced against said at least one wall by the impeller, acts to keep said at least one wall free of dust accumulation.

2. A vacuum cleaner as claimed in claim 1 in which the body includes a wall to mount the impeller.

3. A vacuum cleaner as claimed in claim 1 in which the outlet has a filter to remove any dust that passes through the perforate dust receptacle.

4. A vacuum cleaner as claimed in claim 1 in which the outlet is closed by a perforate second door, pivotally attached to the body.

5. A vacuum cleaner as claimed in claim 1 in which the top, and thus the perforate dust receptacle, is clamped in place by the closed first door.

6. A vacuum cleaner as claimed in claim 1 including an O-ring received in the first door to seal against the relatively rigid top of the perforate dust receptacle.

7. A vacuum cleaner comprising:

a body having an inlet for dust laden air and an outlet;

a first door pivotally mounted to the body and containing the inlet for dust laden air;

an impeller between the inlet and the outlet;

a perforate dust receptacle able to filter dust from the dust laden air, the perforate dust receptacle including a relatively rigid top having an opening substantially flush with the top, the remainder of the dust receptacle being a perforate cylinder attached to the top and having at least one wall;

an inlet pipe extending from the inlet for dust laden air, through the flexible gasket in said opening, and into the perforate dust receptacle when the first door is closed so that the dust receptacle when the first door is closed so that the dust does not escape from the perforate dust receptacle;

a flap formed flush with the top of the perforate dust receptacle, the flap including means for raising and folding the flap over the opening to seal the opening for disposal of the perforate dust receptacle without loss of the dust;

said inlet pipe having an outlet remote from the lid said inlet pipe being directed at said at least one wall whereby dust laden air entering the receptacle is filtered to remove dust and the dust laden air, forced against said at least one wall by the impeller, acts to keep said at least one wall free of dust accumulation.

* * * * *